United States Patent [19]

Benedek et al.

[11] Patent Number: 4,562,704

[45] Date of Patent: Jan. 7, 1986

[54] JEWELRY CLASP

[75] Inventors: Herman Benedek; Mike Fischbein, both of Brooklyn, N.Y.

[73] Assignee: Elegant Merchandising Inc., New York, N.Y.

[21] Appl. No.: 610,967

[22] Filed: May 16, 1984

[51] Int. Cl.[4] ..... A44C 25/00

[52] U.S. Cl. ..... 63/2; 24/616; 29/433; 29/160.6

[58] Field of Search ..... 63/2, 3, 4, 11; 24/614, 24/615, 616, 606, 607, 537; 29/433, 160.6

[56] References Cited

U.S. PATENT DOCUMENTS

| | | | |
|---|---|---|---|
| 1,082,140 | 12/1913 | Schönemann et al. | 24/616 |
| 1,270,769 | 7/1918 | Balch | 24/616 |
| 4,286,360 | 9/1981 | Skobel | 63/2 |
| 4,315,362 | 2/1982 | Pigford et al. | 63/2 X |

FOREIGN PATENT DOCUMENTS

| | | | |
|---|---|---|---|
| 333868 | 3/1921 | Fed. Rep. of Germany | 24/616 |
| 321229 | 6/1957 | Switzerland | 63/11 |

*Primary Examiner*—F. Barry Shay

*Attorney, Agent, or Firm*—McAulay, Fields, Fisher, Goldstein & Nissen

[57] ABSTRACT

A clasp is provided for a jewelry chain, particularly a chain adapted to hold interchangeable designer elements. The clasp has a male and a female member, the male member locking within the female member and being so sized that, when the clasp is opened, the interchangeable beads are easily slid over it and onto the chain; the female member is sized so as to prevent the decorator elements from being removed from the chain. The male member is preferably a spring which is depressed for insertion into the female member, the spring action causing a portion of the male member to lock with a portion of the female member.

5 Claims, 4 Drawing Figures

JEWELRY CLASP

BACKGROUND OF THE INVENTION

The use of jewelry to enhance appearance has been known since antiquity. The particular item of jewelry chosen should complement or accent other items of dress. Frequently, this complementing or accenting of the other items of dress is accomplished through the choice of color of the jewelry item, such as the color of a bead on a necklace or bracelet.

In recent years, necklaces and bracelets have been sold along with a collection of beads to be placed on the necklace or bracelet, the beads being of varying color, design, etc. so that the person wearing the jewelry could select a different color combination or pattern for each item of dress, without having to have an "inventory" of different necklaces and bracelets for each item of dress which was to be worn. The beads employed on a necklace or bracelet on one occasion could be removed from a support, replaced in a storage device, and different beads employed on the support to complement or accentuate a different item of dress.

While the jewelry chains employed to support these different colored or designed beads were generally of the type which had long been used in the jewelry field, being the standard thin strand or chain of loops formed of gold, silver, or some other metal, the clasp presented a different problem. Not only did the jewelry clasp for a necklace or bracelet meant to support varying color beads have to be designed to close the necklace or bracelet, but it also had to be useful with beads that were put on or removed from the chain at the will of the user.

The prior art's normal approach to dealing with the problem was to use two different closure members for the necklace or bracelet. One closure member performed the usual function of holding the two ends of the chain together so that the item of jewelry could be worn, while another clasp or connection device was employed to open the chain for placement of beads onto the chain, or removal of beads from the chain. Not only is this inconvenient, but it also generates additional expense.

SUMMARY OF THE INVENTION

In accordance with the present invention, a jewelry clasp has been developed which provides for the normal function of holding two ends of a jewelry chain together, but, additionally, allows for beads of varying color and design to be placed on the chain and securely held during use without interfering with the closing function of the clasp. Only one connecting means is required on a chain when the jewelry clasp of the present invention is employed.

This dual function is accomplished by forming a clasp with two members, one male and one female. The size of the female member is such that the beads which are placed on the chain are blocked by it and cannot be removed from the chain at that end. The male member of the clasp is formed of a spring material and, in its normally expanded position, also acts to block the beads which are on the chain to prevent their removal from the chain. However, when the male member of the clasp is compressed, against its spring action, beads which are on the chain can be easily removed, or new beads can easily be added to the chain.

Further, the spring action of the male member allows its insertion into and firm holding within the female member of the clasp. Thus, an attractive jewelry clasp is formed, particularly for jewelry chains which are provided for holding differently colored or designed elements at different times, without the necessity for providing additional closure means for the chain.

DESCRIPTION OF THE PREFERRED EMBODIMENTS

Figure 1:
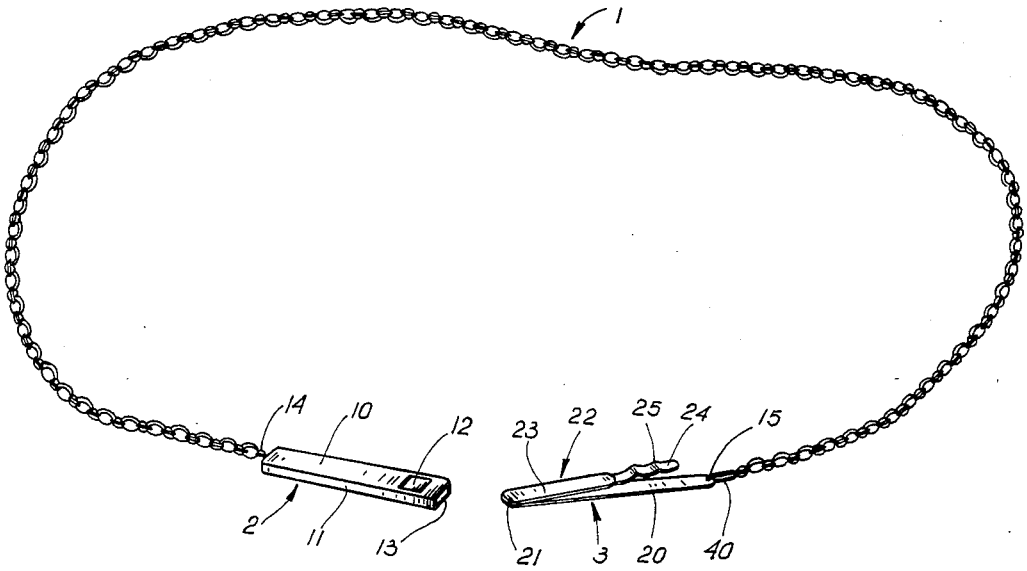
FIG. 1 is a view showing a jewelry chain employing the clasp of the present invention, the male and female members of the clasp being separated.

Referring to the figures, FIG. 1 shows a jewelry chain 1 having, at one end, a female clasp member 2 and, at the opposite end, a male clasp member 3, the female clasp member 2 and the male clas member 3 adapted to be joined so as to close the chain. The chain 1 can be formed of any of the standard materials for jewelry chains, including gold, silver, or other metals.

As can be seen, the female clasp member 2 is a generally elongated member having a top 10, a side 11, an opening 12 in the top 10, and an opening 13 in one end. The bottom, opposite the side 10, is the same size and shape as the top 10, but need not have the opening 12. The edge opposite the edge 11 is similar in size and shape to the edge 11, while the end opposite the opening 13 has the same size and shape as the opening 13, but is closed, being provided with means for attachment of the end 14 of chain 1.

The male member 3 is adapted to be fitted within the opening 13 of the female member 2. Preferably, it is formed of a material which has a spring action and includes a lower portion 20, attached to the end 15 of the chain 1, a bend 21, at the end of portion 20, opposite end 15, and an upper portion 22. The upper portion 22 includes section 23 which is, generally, straight, and a section 24 which includes one or more teats 25, for a purpose to be described.

Figure 2:
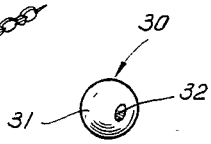
FIG. 2 is a perspective view of a designer element, such as a bead, to be employed in completing the item of jewelry in combination with the chain and clasp of FIG. 1.

Illustrated in FIG. 2 is a decorative member, or bead 30. The decorative member has an outer surface 31 which provides the coloring or decoration which is desired by the user of the jewelry piece illustrated in FIG. 1. Further, the decorative member 30 has an inner opening 32, the size of which is adapted to be receivable over the male member 3 of the clasp, so as to place the decorative member 30 onto the chain portion 1 of the jewelry item, when the male member is compressed.

Figure 3:
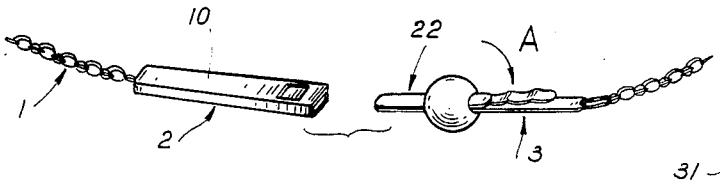
FIG. 3 is a view of a portion of the jewelry chain, showing the male member of the clasp in a compressed mode with a designer element, such as that of FIG. 2, being passed over the male member of the clasp.

FIG. 3 illustrates the placement of one of the decorative items 30 onto the chain 1, or the removal of such decorative item from the chain. Specifically, the male member 3 is compressed in the direction illustrated by arrow A in FIG. 3, so that the section 23 lies adjacent the section 20. In this condition, the male member assumes a condition which is thin enough to accommodate the opening 32 of the decorative member 30. After the decorative member 30 has passed over the male member 3, it is easily accommodated by the chain 1, and can assume any position on the chain 1 desired by the wearer of the jewelry item. While FIG. 4 shows only four of the decorative items 30, or beads, if will be appreciated that the entire chain length 1 can be filled with the decorative items 30, so that no portion of the chain is observable.

When the decorative item 30 has passed over the male member 3, and been placed on the chain, and pressure is removed from the section 23 of the male clasp member 3, the spring action of the male member 3 causes the section 23 to move upwardly, opposite the direction of arrow A, and to be separated from the section 20 of the male member. With the sections 20 and 23 separated, the opening 32 of the decorative member 30 is too small to pass over the male member, and the decorative item 30 is thus held onto the chain 1.

Figure 4:
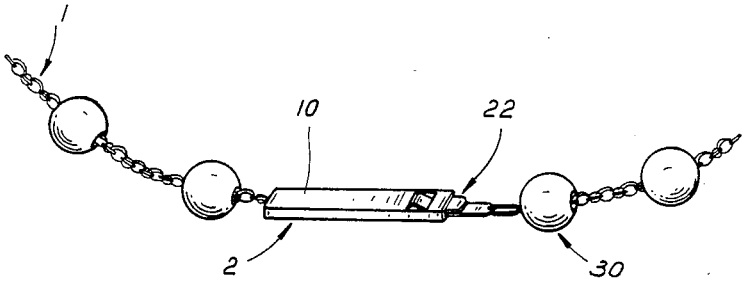
FIG. 4 is a view of a portion of the jewelry chain of FIG. 1, having designer elements in place, and with the clasp in a closed or joined position.

FIG. 4 illustrates the clasp, including female member 2 and male member 3 in the joined condition. The male member 3 is forced into the female member 2, acting to force section 23 against section 20, against the spring action of the material of which the male member 3 is formed. When the insertion is sufficient, and the length of section 20 can be such as to correspond with the length of female member 2, the spring action of the male member 3 causes the section 23 to move upwardly, opposite the direction of arrow A, in accordance with the spring action of the member. This causes teat 25 to lodge in opening 12 formed in upper surface 10 of female member 2. When the teat 25 has lodged in the opening 12, removal of the male member 3 from the female member 2 is possible only by depressing the teat 25, and thus section 23, so that the male member 3 may be slid out of the female member 2, thus opening the chain 1. If the decorative items 30 are to then be removed from the chain, the section 23 must be compressed against the section 20, in the same manner as in FIG. 3, so that the decorative items 30 can be moved over the male member 3 and be removed from the jewelry item. Obviously, as previously indicated, if the section 23 is not compressed against the section 20, the male member 3 is too large for the opening 32 of decorative item 30 to pass over the male member, and the decorative item is held onto the overall jewelry item.

As previously indicated, the jewelry clasp of the present invention provides a single joining means for the chain 1, the single joining means allowing both the application and removal of designer items 30, such as beads, onto and from the chain, and the joining of the ends 14 and 15 of the chain 1. The sizing of the female member 2 is such that the designer members 30 cannot be removed from the chain at the female member end of the chain, as the female member 2 is too large for the opening 32 of the decorative item 30 to pass over it. Similarly, when the section 23 of the male member 3 is not compressed against the section 20, the opening 32 of the decorative item 30 will not pass over the male member of the clasp. However, when the section 23 is compressed against the section 20, its size is such that the opening 32 will pass over the male member 3, allowing the decorative item 30 to be placed on the chain 1.

The prior art has shown systems with male and female clasp members. For example, such constructions are shown in U.S. Pat. No. 1,807,293, Keller; U.S. Pat. No. 2,986,792, Wyatt; U.S. Pat. No. 3,412,576, Hodge. However, none of the clasp systems just referred to allow for the placement of a designer element onto a jewelry chain where the clasp is employed as a means for the placement of the designer element and also for retaining the designer element on the chain. In each of the patents referred to, the male member is too large, even in a compressed state, to allow for placement of the referenced designer element.

A further advantage to the structure of the present invention is the construction of the chain link 40. In prior constructions, it was necessary to form this chain link as a large, round member. In accordance with the present invention, the link can be formed, as shown, as an elongate member.

To some extent, the terms "bead" and "designer element" have been used interchangeably in this specification. While the normal designer element which is employed with a jewelry item in accordance with the present invention is a colored or otherwise decorated bead, it will be appreciated that the present invention is not limited to the use of a bead. Any designer element, such as a pendant, drop, etc. can be employed, so long as a portion is provided having a small opening corresponding to the opening 32 shown in the bead to allow for placement of the designer element onto the chain, or removal of the designer element from the chain, employing the male clasp member 3 in the manner described.

While the specific embodiments of the invention have been shown and described, the invention should not be considered as limited, except as set forth in the appended claims.

We claim:

1. In a jewelry item comprising a chain, a clasp for said chain, and a designer element formed to fit onto the chain and having a central opening, the improvement which comprises:

a. a female clasp element attached to one end of said chain and being sized so as to prevent removal of said designer elements from said chain; and b. a male clasp element formed of a material having spring-like properties, said male element including resilient expandable and compressible means for cooperation with said female element to clasp and unclasp said clasp elements and for preventing removal of said designer element from said chain when said male element is in an expandd unclasped condition, but permitting placement of said designer elements onto said chain, or removal of said designer elements from said chain, when said male member is unclasped and compressed;

said male elements and said female elements being adapted to be united so as to close the ends of said chain.

2. The jewelry clasp of claim 1 wherein the male clasp element is further in the shape of a V, compression of the clasp element being accomplished through movement of the two legs of the V toward each other.

3. The jewelry clasp of claim 2 wherein said female element is essentially rectangular in form, one face of said element being provided with a perimeter defining an opening, the free leg of the V of said male member being provided with a teat, said teat interengaging with said perimeter when said male and said female elements are joined.

4. The jewelry clasp of claim 1 wherein said male element is joined to one end of said chain by an elongated chain link.

5. The system of claim 1 wherein said designer element is a bead.

* * * * *